US010533269B2

(12) United States Patent
Hussey et al.

(10) Patent No.: US 10,533,269 B2
(45) **Date of Patent: *Jan. 14, 2020**

(54) TEXTILE, GARMENT INCLUDING THE TEXTILE, AND METHODS FOR MANUFACTURING THE TEXTILE AND THE GARMENT

(71) Applicant: XEFCO PTY LTD, Lilyfield (AU)

(72) Inventors: Thomas Kenneth Hussey, Balmain (AU); Brian Conolly, Northwood (AU); Bartosz Milczarczyk, Umina Beach (AU)

(73) Assignee: XEFCO PTY LTD, Lilyfield (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/784,862

(22) Filed: Oct. 16, 2017

(65) Prior Publication Data

US 2018/0044823 A1 Feb. 15, 2018

Related U.S. Application Data

(63) Continuation of application No. 14/823,453, filed on Aug. 11, 2015, now Pat. No. 9,790,625.

(30) Foreign Application Priority Data

Aug. 11, 2014 (AU) ..... 2014903123
May 4, 2015 (AU) ..... 2015901582

(51) Int. Cl.
*A41D 31/00* (2019.01)
*D03D 15/08* (2006.01)
(Continued)

(52) U.S. Cl.
CPC ..... *D03D 15/08* (2013.01); *A41D 13/012* (2013.01); *A41D 27/24* (2013.01); *A41D 31/065* (2019.02);
(Continued)

(58) Field of Classification Search
CPC . B63C 11/04; B63C 2011/046; A41D 13/012; A41D 27/24; A41D 31/0038;
(Continued)

(56) References Cited

U.S. PATENT DOCUMENTS 2,115,368 A * 4/1938 Lustberg ..... A41D 27/24 2/275
5,003,902 A * 4/1991 Benstock ..... A41D 27/24 112/402
(Continued)

FOREIGN PATENT DOCUMENTS

EP 2204101 A1 7/2010
WO 9818852 A1 5/1998
(Continued)

OTHER PUBLICATIONS

International Preliminary Report on Patentability Application No. PCT/IB2015/001507 Completed Date: Feb. 14, 2017 9 Pages.
(Continued)

*Primary Examiner* — Robert H Muromoto, Jr.
(74) *Attorney, Agent, or Firm* — Nixon & Vanderhye P.C.

(57) ABSTRACT

A textile is provided that includes a plurality of warp yarns and a plurality of weft yarns woven together, the plurality of warp yarns each including an elastic warp filament and a non-elastic warp filament, and the plurality of weft yarns each including an elastic weft filament and a non-elastic weft filament. At least one of the elastic warp filament, the non-elastic warp filament, the elastic weft filament, and the non-elastic weft filament includes a hydrophobic material. The materials of the elastic warp filament, the non-elastic warp filament, the elastic weft filament, and the non-elastic weft filament are selected such that the textile has a high elastic stretchability in at least one of a weft direction and a warp direction. A garment including the textile, and methods
(Continued)

for manufacturing the textile and the garment, are also disclosed.

22 Claims, 18 Drawing Sheets

(51) Int. Cl.

| | |
|---|---|
| ***D03D 1/00*** | (2006.01) |
| ***A41D 13/012*** | (2006.01) |
| ***A41D 27/24*** | (2006.01) |
| ***A41D 31/06*** | (2019.01) |
| *A41D 7/00* | (2006.01) |

(52) U.S. Cl.
CPC ..... *D03D 1/00* (2013.01); *D10B 2401/021* (2013.01); *D10B 2401/061* (2013.01); *D10B 2501/04* (2013.01)

(58) Field of Classification Search
CPC ..... A41D 1/08; A41D 7/00; A41D 2400/22; A41D 31/0027; A41D 31/0083
See application file for complete search history.

(56) References Cited

U.S. PATENT DOCUMENTS 6,083,628 A * 7/2000 Yializis ..... B05D 1/60 428/461
7,395,553 B2 * 7/2008 O'Hara ..... A41D 13/012 2/2.15
7,849,518 B2 * 12/2010 Moore ..... A41D 1/08 2/220
8,993,089 B2 * 3/2015 Conolly ..... B32B 15/046 428/135
9,315,247 B2 * 4/2016 Hussey ..... B63C 11/04
9,790,625 B2 * 10/2017 Hussey ..... D03D 15/08
2012/0023631 A1 * 2/2012 Fischer ..... A41D 13/012 2/2.15
2013/0247268 A1 * 9/2013 Niwa ..... A41D 7/00 2/67

FOREIGN PATENT DOCUMENTS

WO 2009125438 A1 10/2009
WO 2014056966 A1 4/2014

OTHER PUBLICATIONS

International Search Report Application No. PCT/IB2015/001507 Completed: Dec. 10, 2015;dated Dec. 10, 2015 7 pages.
U.S. Office Action U.S. Appl. No. 14/823,453 dated Sep. 16, 2016 6 Pages.
U.S. Office Action U.S. Appl. No. 14/823,453 dated Dec. 30, 2016 11 Pages.
Witten Opinion of the International Searching Authority Application No. PCT/IB2015/001507 Completed: Dec. 10, 2015; dated Dec. 10, 2015 8 pages.

* cited by examiner

| Textile | Yarn filament materials | Surface Density (gsm) | Hydrophobic Treatment | Dry Weight (g) | Wet Weight (g) | $H_20$ Content (g) | % Increase of Weight in $H_20$ |
|---|---|---|---|---|---|---|---|
| Prior art knitted textile 1a | 80% Nylon; 20% Elastane | 200 | None | 12.8 | 35.4 | 22.6 | 177% |
| Prior art knitted textile 1b | 80% Nylon; 20% Elastane | 200 | DWR via dipping | 13.4 | 17.2 | 3.8 | 28% |
| Prior art knitted textile 1c | 80% Nylon; 20% Elastane | 200 | DWR via PECVD | 12.1 | 14.4 | 2.3 | 19% |
| | | | | | | | |
| Present textile 1a | 77% Polyester; 23% Elastane | 170 | None | 10.3 | 27.5 | 17.2 | 167% |
| Present textile 1b | 77% Polyester; 23% Elastane | 170 | DWR via dipping | 11.3 | 12.1 | 0.8 | 7% |
| Present textile 1c | 77% Polyester; 23% Elastane | 170 | DWR via PECVD | 9.9 | 10.4 | 0.5 | 5% |
| | | | | | | | |
| Present textile 2a | 75% Nylon; 25% Elastane | 140 | None | 9.0 | 22.2 | 13.3 | 148% |
| Present textile 2b | 75% Nylon; 25% Elastane | 140 | DWR via dipping | 9.2 | 9.8 | 0.6 | 7% |
| Present textile 2c | 75% Nylon; 25% Elastane | 140 | DWR via PECVD | 9.2 | 9.5 | 0.3 | 3% |

FIG. 20

TEXTILE, GARMENT INCLUDING THE TEXTILE, AND METHODS FOR MANUFACTURING THE TEXTILE AND THE GARMENT

CROSS-REFERENCE TO RELATED APPLICATIONS

This disclosure a continuation of pending U.S. application Ser. No. 14/823,453, filed Aug. 11, 2015, which claims priority to Australian Provisional Patent Application No. 2014903123, filed Aug. 11, 2014, and Australian Provisional Patent Application No. 2015901582, filed May 4, 2015, the disclosures of which are hereby incorporated by reference in their entirety.

FIELD OF THE INVENTION

This disclosure generally relates to textiles and garments, and methods for manufacturing the same, and more particularly relates to textiles and garments suitable for aquatic activities, and methods for manufacturing the same.

BACKGROUND OF THE INVENTION

There are various types of garments that are commonly used for aquatic sports (e.g., surfing, sailing, paddling, swimming, diving, scuba diving, etc.) and other aquatic activities (collectively, "aquatic activities").

It is known in the art to provide a garment having a knitted textile. Such garments can be constructed of a very high stretch knitted textile and configured to be form-fitting, or can be constructed of a less stretchable knitted textile and configured to fit more loosely. Garments with knitted textiles can have good breathability, drape, and stretch characteristics; however, when exposed to water, such garments can become heavy and cold due to the inherently high absorbent construction of knitted textiles. When a knitted textile becomes saturated with water, the thermal conductivity of the garment is significantly increased due to the high thermal conductivity of water and evaporative cooling effects of the wet knitted textile. Further, the stretch recovery of knitted textiles can be reduced when wet, causing the garment to stretch and sag, and thereby reducing wearer comfort.

It is known in the art to provide a garment having a knitted textile with a durable water repellent (DWR) coating or treatment. Although a DWR coating or treatment can provide some resistance to the absorbance of water, water can still be absorbed during the normal life of the garment. In addition, the effectiveness of a DWR coating or treatment reduces during the normal life of the garment due to washing and abrasion, allowing the garment to absorb more water, and stretch and sag during use.

It is also known in the art to provide a garment having a stretch-woven textile. Stretch-woven textiles can also be relatively light and thin, and can provide excellent coverage of the wearer's body. Stretch-woven textiles can be configured to have excellent stretch recovery compared to knitted textiles, due to reduced friction and movement between yarns when in their elongated state. Improved stretch recovery allows garments having stretch-woven textiles to return to their original shape and therefore provide improved fit and comfort to the wearer. This is particularly important when used in wet conditions.

Yarns within known stretch-woven textiles are typically arranged in a very close and tight structure, with very small gaps between adjacent yarns, as compared to the yarns in known knitted textiles. Stretch-woven textiles can be configured to absorb less water content than stretchable knitted textiles, due at least in part to smaller spaces between yarns. In addition, when a stretch-woven textile is comprised of a hydrophobic material, or is provided with a DWR coating or treatment, the stretch-woven textile can exhibit excellent hydrophobicity compared to knitted textiles, due at least in part to smaller spaces between yarns and/or the relatively smooth surface texture of the stretch-woven textile.

It is known in the art to use a stretch-woven textile to produce a loose-fitting water short for use in aquatic activities. For example, U.S. Pat. No. 7,849,518 discloses a loose-fitting water short that includes a stretch-woven textile.

It is known in the art to use a stretch-woven textile to produce a tight-fitting, high-performance swimsuit. Such swimsuits are known to provide improved hydrodynamic performance and reduced drag. For example, International Patent Publication No. 2009/125438 discloses a stretch-woven textile having a polytetraflouroethylene-based (PTFE-based) coating to provide hydrophobic function for use in high-performance swimsuits. Although such textiles can provide good hydrodynamics for high-performance use, the high modulus of elasticity and the touch of the textile has generally been uncomfortable for use in other garments. Also, the construction of the textile provides good hydrophobic performance when the PTFE-based coating is applied, but the durability of the PTFE-based coating is not adequate to provide continuous water repellency to the garments during normal use.

It is known in the art to provide a substantially waterproof garment. Such garments typically include a substantially waterproof composite material, such as a textile laminated with a neoprene foam or another waterproof film or coating. Such garments are commonly configured to be form-fitting, and include a high stretch knitted textile to allow high stretch and freedom of movement to the wearer. For example, U.S. Pat. No. 7,395,553 discloses a wetsuit material having a wool inner layer attached to neoprene foam. U.S. Patent Publication No. 2012/0023631 discloses another substantially waterproof garment. Substantially waterproof garments can provide good thermal insulation to the wearer, but can have poor breathability. Also, substantially waterproof garments are not suitable for high metabolic activity or warm weather conditions.

Several methods for providing hydrophobic functional layers to textiles are known in the art. The most common methods involve the application of fluorocarbon-based chemicals via a bath or dipping process, pad treatment process, and/or spray or other processes. Other methods known in the art include deposition or polymerization of thin organic or in-organic layers via a process of vacuum vapor deposition. For example, International Patent Publication No. 2014/056966 discloses a method of coating a textile via a process of contacting a fabric with a monomer and subjecting it to low power plasma polymerization in a low pressure vacuum. The monomer can be selected to provide hydrophobicity and/or oleophobicity.

Aspects of the present invention are directed these and other problems.

SUMMARY OF THE INVENTION

According to an aspect of the present invention, a textile is provided that includes a plurality of warp yarns and a plurality of weft yarns woven together, the plurality of warp yarns each including an elastic warp filament and a non-elastic warp filament, and the plurality of weft yarns each including an elastic weft filament and a non-elastic weft filament. At least one of the elastic warp filament, the non-elastic warp filament, the elastic weft filament, and the non-elastic weft filament includes a hydrophobic material. The materials of the elastic warp filament, the non-elastic warp filament, the elastic weft filament, and the non-elastic weft filament are selected such that the textile has a high elastic stretchability in at least one of a weft direction and a warp direction.

According to another aspect of the present invention, a garment is provided that includes a first panel of a first textile. The first textile includes a plurality of warp yarns and a plurality of weft yarns woven together, the plurality of warp yarns each including an elastic warp filament and a non-elastic warp filament, and the plurality of weft yarns each including an elastic weft filament and a non-elastic weft filament. At least one of the elastic warp filament, the non-elastic warp filament, the elastic weft filament, and the non-elastic weft filament includes a hydrophobic material. The materials of the elastic warp filament, the non-elastic warp filament, the elastic weft filament, and the non-elastic weft filament are selected such that the textile has a high elastic stretchability in at least one of a weft direction and a warp direction.

According to another aspect of the present invention, a method for manufacturing a textile is provided that includes the steps of: weaving together a plurality of warp yarns and a plurality of weft yarns, the plurality of warp yarns each including an elastic warp filament and a non-elastic warp filament, and the plurality of weft yarns each including an elastic weft filament and a non-elastic weft filament; selecting materials of the elastic warp filament, the non-elastic warp filament, the elastic weft filament, and the non-elastic weft filament such that the textile has a high elastic stretchability in at least one of a weft direction and a warp direction; and providing at least one of the elastic warp filament, the non-elastic warp filament, the elastic weft filament, and the non-elastic weft filament with a hydrophobic material.

According to another aspect of the present invention, a method for manufacturing a garment is provided that includes the step of adjoining a first panel of a first material and a second panel of a second material along a seam to thereby form a substantially water-tight seal between the first panel and the second panel.

In addition to, or as an alternative to, one or more of the features described above, further aspects of the present invention can include one or more of the following features, individually or in combination:

- the elastic warp filament and the elastic weft filament are made of an elastic polyurethane or an elastane, and the non-elastic warp filament and the non-elastic weft filament are made of a polyester, a polyamide, or a polypropylene;
- the hydrophobic material is a DWR material that is coated on the at least one of the of the elastic warp filament, the non-elastic warp filament, the elastic weft filament, and the non-elastic weft filament;
- the hydrophobic material is an organic material that is coated on the at least one of the of the elastic warp filament, the non-elastic warp filament, the elastic weft filament, and the non-elastic weft filament;
- the hydrophobic material is an inorganic material that is coated on the at least one of the of the elastic warp filament, the non-elastic warp filament, the elastic weft filament, and the non-elastic weft filament;
- the hydrophobic material is coated on the at least one of the of the elastic warp filament, the non-elastic warp filament, the elastic weft filament, and the non-elastic weft filament via chemical vapor deposition;
- the chemical vapor deposition is a plasma-enhanced chemical vapor deposition (PECVD);
- the hydrophobic material is coated on the at least one of the of the elastic warp filament, the non-elastic warp filament, the elastic weft filament, and the non-elastic weft filament via plasma polymerization;
- adhesion of the hydrophobic material to the at least one of the of the elastic warp filament, the non-elastic warp filament, the elastic weft filament, and the non-elastic weft filament of the warp yarns is enhanced via a corona pre-treatment;
- the elastic warp filament and the non-elastic warp filament are twisted about one another, and the elastic weft filament and the non-elastic weft filament are twisted about one another;
- the non-elastic warp filament is coiled about the elastic warp filament, and the non-elastic weft filament is coiled about the elastic weft filament;
- the textile has at least 30% elongation stretchability in at least one of a weft direction and a warp direction prior to tensile failure of the textile;
- the warp yarns each include a plurality of elastic warp filaments and a plurality of non-elastic warp filaments, and the weft yarns each include a plurality of elastic weft filaments and a plurality of non-elastic weft filaments;
- the warp yarns each include one elastic warp filament and between 5 and 80 non-elastic warp filaments, and the weft yarns each include one elastic weft filament and between 5 and 80 non-elastic weft filaments;
- at least one of the warp yarns and the weft yarns are texturized to provide a soft hand feel;
- the garment further includes a second panel of the first textile, the first panel and the second panel being adjoined together along a seam that forms a substantially water-tight seal between the first panel and the second panel;
- the seam includes a hydrophobic material;
- the seam has a flat seam construction, including a stitch yarn that is looped through the first panel and the second panel, the stitch yarn including a hydrophobic material;
- the seam has a folded seam construction including a stitch yarn that is looped through the first panel and the second panel, and the stitch yarn does not include a hydrophobic material;
- the seam has a fused seam construction, including a stretchable adhesive disposed relative to the first panel and the second panel;
- the stretchable adhesive includes a hydrophobic material;
- the seam includes an adhesive tape;
- the adhesive tape includes a hydrophobic material;
- the garment further includes a second panel of a second textile, the second textile being different from first textile, the first panel and the second panel being adjoined together along a seam;
- the seam forms a substantially water-tight seal between the first panel and the second panel;
- the second material is a knitted textile;
- the second panel is positioned on the garment such that, when the garment is worn, the second panel is located proximate an area of a wearer's body where increased air permeability is typically desired;

the second material is a liquid impermeable stretchable textile composite;

the garment further includes a second panel of a second textile, the second textile being the same as the first textile, the first panel and the second panel being adjoined together along a first seam that forms a substantially water-tight seal between the first panel and the second panel, and a second seam formed between at least two panels of different textiles, the at least two panels being adjoined together along a second seam that does not form a substantially water-tight seal between the at least two panels;

the first panel includes a plurality of perforations extending therethrough for air permeability;

the garment further includes a second panel, and the second panel includes a plurality of perforations extending therethrough for air permeability;

the garment is designed to be loose-fitting on a wearer;

the garment is designed to be form-fitting on a wearer;

the garment includes a waistband made of a material with a relatively high elastic modulus and/or a high friction grip material;

the garment defines an opening for an arm, a leg, or a neck;

an elastomeric band is positioned on an inside of the garment proximate the opening, the band having a high amount of friction for holding the garment in place on a wearer;

the garment includes padding positioned on the garment such that, when the garment is worn, the padding is located proximate an area of the wearer's body where padding is desired;

the method further includes the step of coating or treating the first panel and the second panel with a hydrophobic material after the adjoining step; and the coating or treating step involves at least one of a PECVD technique and a plasma polymerization technique.

These and other aspects of the present invention will become apparent in light of the drawings and detailed description provided below.

BRIEF DESCRIPTION OF THE DRAWINGS

FIG. 20 illustrates a table with data showing improved water resistance over known textiles.

DETAILED DESCRIPTION OF THE INVENTION

Figure 1:
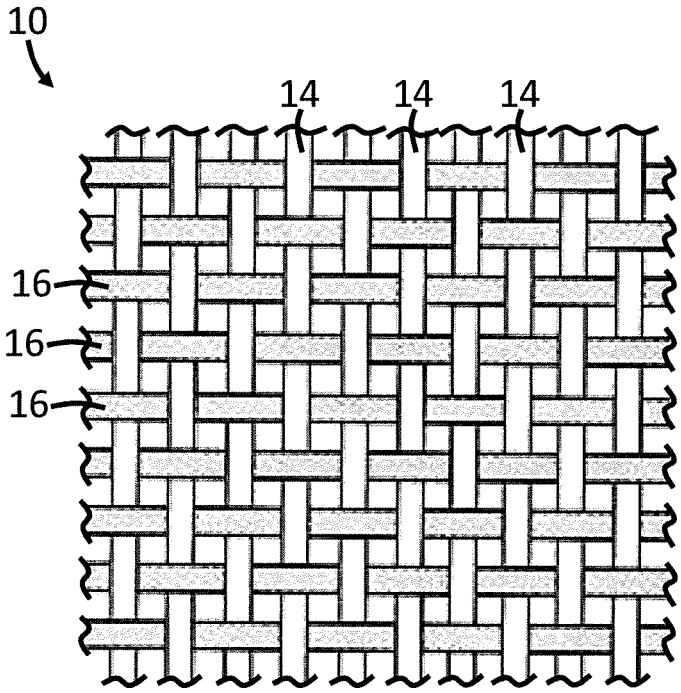
FIG. 1 schematically illustrates a plan view of an embodiment of the present textile.

Referring now to the drawings, the present disclosure describes a textile 10 (see FIG. 1), a garment 12 including the textile 10 (see FIGS. 3A-17), and methods for manufacturing the textile 10 and the garment 12. The textile 10 and the garment 12 are suitable for use during aquatic activities.

The textile 10 includes a plurality of warp yarns 14 and a plurality of weft yarns 16 that are woven together. The warp yarns 14 include one or more elastic warp filaments 18 and one or more non-elastic warp filaments 20 (collectively, the "warp filaments 18, 20"). Similarly, the weft yarns 16 include one or more elastic weft filaments 22 and one or more non-elastic weft filaments 24 (collectively, the "weft filaments 22, 24"). The respective materials of the filaments 18, 20, 22, 24 are selected such that the textile 10 has a high elastic stretchability in one or both of a weft direction and a warp direction. Also, at least one of the elastic warp filaments 18, the non-elastic warp filaments 20, the elastic weft filaments 22, and the non-elastic weft filaments 24 includes (e.g., are formed of, are coated with, are treated with) at least one hydrophobic material. The inclusion of the hydrophobic material increases the hydrophobicity of the textile 10, and thus increases the ability of the textile 10 to repel water during wet conditions.

Referring to FIGS. 3A-17, the garment 12 includes one or more panels 26 of the present textile 10 and, in some embodiments, additionally includes one or more panels 28 of a different material. At least two of the panels 26, 28 are adjoined together along a seam 30, as will be described in detail below.

Figure 2A:
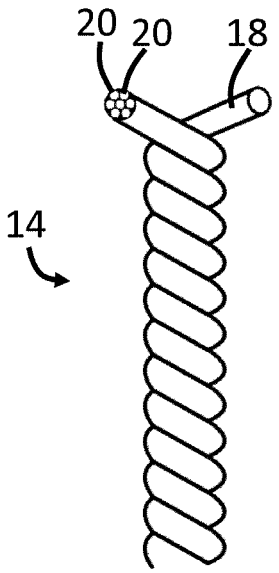
FIGS. 2A and 2B schematically illustrate front elevation views of an embodiment of the warp and weft yarns, respectively.
Figure 2B:
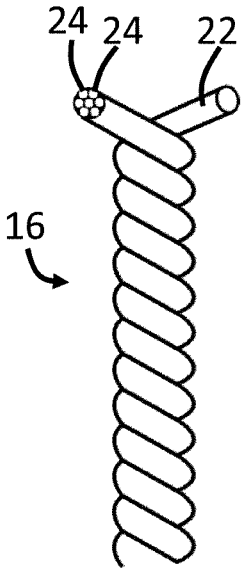

The textile 10 (see FIG. 1), and the warp and weft yarns 14, 16 thereof (see FIGS. 2A and 2B), will now be described in detail.

The textile 10 can include a predetermined number of warp yarn 14 threads per inch and/or a predetermined number of weft yarn 16 threads per inch. In some embodiments, for example, the number of warp yarn 14 threads per inch, and/or the number of weft yarns 16 per inch, can be: (i) between 130 and 200 threads per inch; (ii) between 130 and 180 threads per inch; or (iii) between 150 and 250 threads per inch.

The textile 10 defines a surface density (e.g., a mass per square meter) that can vary depending on one or more design considerations. In some embodiments, the surface density of the textile 10 can be between 80 and 250 grams per square meter (gsm).

Figure 2C:
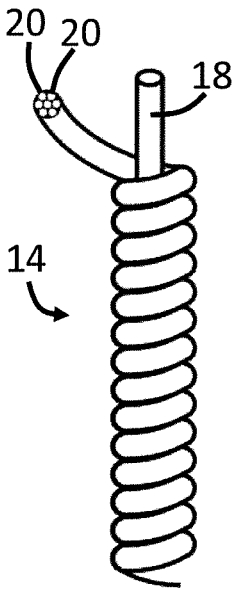
FIGS. 2C and 2D schematically illustrate front elevation views of another embodiment of the warp and weft yarns, respectively.
Figure 2D:
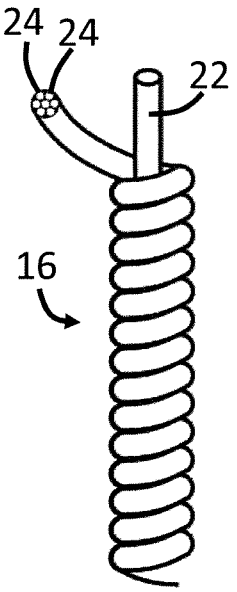

The warp filaments 18, 20 can be configured relative to one another in several different ways. The weft filaments 22, 24 can be configured in a same or different manner as the warp filaments 18, 20. In some embodiments (see FIGS. 2A and 2B), the one or more elastic warp filaments 18 can be twisted relative to the one or more non-elastic warp filaments 20 (see FIG. 2A), and/or the one or more elastic weft filaments 22 can be twisted relative to the one or more non-elastic weft filaments 24 (see FIG. 2B). In other embodiments (see FIGS. 2C and 2D), the one or more non-elastic warp filaments 20 can be coiled about the one or more elastic warp filaments 18 (see FIG. 2C), and/or the one or more non-elastic weft filaments 24 can be coiled about the one or more elastic weft filaments 22 (see FIG. 2D). Such twisting and coiling configurations of the warp filaments 18, 20 and/or the weft filaments 22, 24 can aid in providing the textile 10 with a high elongation stretchability (prior to tensile failure of the textile 10) in a warp direction and/or a weft direction, respectively. In some embodiments, for example, the textile 10 can have: (i) at least 30% elongation stretchability in a warp direction and/or a weft direction; (ii) at least 100% elongation stretchability in a warp direction and/or a weft direction; and/or (iii) at least 150% elongation stretchability warp direction and/or a weft direction.

The warp yarns 14 and the weft yarns 16 can each include a predetermined number of filaments 18, 20, 22, 24. Also, the relative numbers of elastic filaments 18, 22 and non-elastic filaments 20, 24 included in each of the warp yarns 14 and the weft yarns 16 can be predetermined. The respective numbers of warp filaments 18, 20 can be the same as or different than the respective numbers of weft filaments 22, 24. In some embodiments, the warp yarns 14, for example, can each include: (i) between ten percent and forty percent (10-40%) elastic warp filaments 18 and between sixty percent and ninety percent (60-90%) non-elastic warp filaments 20; and/or (ii) between fifteen percent and twenty-five percent (15-25%) elastic warp filaments 18 and between seventy-five percent and eighty-five percent (75-85%) non-elastic warp filaments 20. Further, in some embodiments, the warp yarns 14 can each include: (i) only one elastic warp filament 18; and/or (ii) between five and eighty (5-80) non-elastic warp filaments 20.

The warp yarns 14 and the weft yarns 16 each have a linear mass density that can vary depending, at least in part, on the respective numbers of filaments 18, 20, 22, 24 included therein. The linear mass density of the warp yarns 14 can be the same as or different than the linear mass density of the weft yarns 16. The respective linear mass densities of the warp yarns 14 and/or the weft yarn 16 can be: (i) between 5 and 80 denier; (ii) between 5 and 30 denier; (iii) between 20 and 30 denier; (iv) between 30 and 60 denier; or (v) between 20 and 80 denier.

The warp yarns 14 each define a warp yarn surface area, and the weft yarns 16 each define a weft yarn surface area. The warp filaments 18, 20 can have one or more predetermined cross-sectional shapes that can be selected at least in part to achieve a desired warp yarn surface area, which in turn can aid in preventing the textile 10 from absorbing water during wet conditions. Similarly, the weft filaments 22, 24 can have one or more predetermined cross-sectional shapes that can be selected at least in part to achieve a desired weft yarn surface area, which in turn can aid in achieving a desired water absorbency of the textile 10. In some embodiments, for example, the non-elastic warp filaments 20 and the non-elastic weft filaments 24 each have round cross-sectional shapes that allow for reduced warp yarn surface areas and reduced weft yarn surface areas, respectively, and in turn aid in preventing the textile 10 from absorbing water during wet conditions.

The warp yarns 14 and/or the weft yarns 16 can be texturized using one or more known texturizing techniques (e.g., draw texturizing, air texturizing). Such texturing can be advantageous in that it can provide the textile 10 with a soft hand feel.

The elastic warp filaments 18 and the elastic weft filaments 22 can be made of various different elastic materials. Acceptable materials for the elastic warp filaments 18 and the elastic weft filaments 22 include, but are not limited to, an elastic polyurethane and an elastane.

The non-elastic warp filaments 20 and the non-elastic weft filaments 24 can be made of various different non-elastic materials. In some embodiments, the non-elastic warp filaments 20 and/or the non-elastic weft filaments 24 include at least one filament made of a synthetic material, and/or at least one filament made of a natural material. In other embodiments, the non-elastic warp filaments 20 and/or the non-elastic weft filaments 24 are all made of a synthetic material. Acceptable synthetic materials for the non-elastic warp filaments 20 and the non-elastic weft filaments 24 include, but are not limited to, a polyester, a polyamide (e.g., nylon), and a polypropylene. Acceptable natural materials include, but are not limited to, wool and cotton.

As indicated above, at least one of the elastic warp filaments 18, the non-elastic warp filaments 20, the elastic weft filaments 22, and the non-elastic weft filaments 24 includes at least one hydrophobic material. In some embodiments, at least one of the filaments 18, 20, 22, 24 is formed of the hydrophobic material. In other embodiments, at least one of the filaments 18, 20, 22, 24 is coated with or treated with the hydrophobic material. In such embodiments, the filaments 18, 20, 22, 24 can be coated or treated with the hydrophobic material before and/or after the warp and weft yarns 14, 16 are woven together to form the textile 10, before and/or after any dyeing of the textile 10, and/or before and/or after any finishing of the textile 10. In still other embodiments, a treatment (e.g., a corona treatment) can be performed on at least one of the filaments 18, 20, 22, 24 to render one or more materials of the filaments 18, 20, 22, 24 hydrophobic.

In some embodiments, the hydrophobic material is a DWR material. The DWR material can include various different chemicals or combinations of chemicals, including, for example, fluorinated polymers, polyurethanes, silicones, paraffins, stearic acic-melamine, dendrimers, nano-materials, and/or other chemicals that are suitable to repel water.

The DWR material can be coated onto at least one of the filaments 18, 20, 22, 24 using one or more known techniques (e.g., a pad/cure/dry technique, a bath technique, screen printing, ink jet printing, dip coating, spray coating, foam coating, blade coating, exhaustion, chemical vapor deposition, PECVD, etc.).

In some embodiments, the at least one hydrophobic material is an organic material and/or an inorganic material. The organic material and/or the inorganic material can include various different chemicals or combinations of chemicals, as described below. The organic material and/or the inorganic material can be coated onto at least one of the filaments 18, 20, 22, 24 using one or more techniques, as described below.

In some embodiments, the organic material and/or the inorganic material includes an acrylate. Fluorinated acrylates, which exhibit very low intermolecular interactions, can be particularly useful in some embodiments, and can have weight average molecular weights up to approximately 6000. Some acrylates have at least one double bond, and in some instances at least two double bonds within the molecule, to provide high-speed polymerization. Examples of acrylates that can be particularly useful here are described in U.S. Pat. No. 6,083,628 and International Patent Publication No. 1998/18852.

In some embodiments, the inorganic material includes organosilanes and/or metal alkoxides (e.g., titanium, tungsten, and/or zinc). In other embodiments, the organic material and/or the inorganic material includes a methacrylate polymer or oligomer. Vacuum compatible oligomers or low molecular weight polymers include diacrylates, triacrylates, higher molecular weight acrylates functionalized as described below; aliphatic, alicyclic, or aromatic oligomers or polymers; and fluorinated acrylate oligomers or polymers.

In some embodiments, the organic material and/or the inorganic material includes one or more functional materials that provide additional functionality, including, for example: (i) antimicrobial materials formed from monomers and/or sol-gels with antimicrobial functional groups and/or encapsulated antimicrobial agents (including chlorinated aromatic compounds and naturally occurring antimicrobials); (ii) fire retardant materials formed from monomers and/or sol-gels with a brominated functional group; (iii) self-cleaning materials formed from monomers and/or sol gels with photocatalytically active chemicals present (including zinc oxide, titanium dioxide, tungsten dioxide and other metal oxides); and (iv) ultraviolet (UV) protective materials formed from monomers and/or sol-gels that contain UV absorbing agents (including highly conjugated organic compounds and metal oxide compounds).

The organic material and/or the inorganic material can be coated on at least one of the filaments 18, 20, 22, 24 by a process of chemical vapor deposition, PECVD, plasma polymerization, glow discharge deposition, a sol-gel process, and/or other known techniques. In some embodiments, the filaments 18, 20, 22, 24 to be coated can be pre-treated by a cleaning, etching, and/or activation step (e.g., a corona pre-treatment step) using a plasma. In such embodiments, the pre-treatment can aid in improving adhesion of the hydrophobic material to the respective filaments 18, 20, 22, 24. In some embodiments, the organic material and/or the inorganic material can be coated on at least one of the filaments 18, 20, 22, 24 in two or more steps, in which a coating is first applied on a first surface, and then applied on a second surface. In some embodiments, the organic material and/or the inorganic material can be coated on the filaments 18, 20, 22, 24 that are exposed after the warp and weft yarns 14, 16 have been woven together. In such embodiments, the organic material and/or the inorganic material can be applied in a manner that does not significantly reduce the air permeability of the textile 10 by blocking pores within the textile 10.

In some embodiments, the organic material and/or the inorganic material can be rendered hydrophobic and/or oleophobic by the inclusion of a functional component such as a monomer and/or sol-gel that contains fluorinated functional groups and/or monomers that create a nanostructure on the surface of the textile 10. In such embodiments, the monomer can include the following general formula $$C_nF_{2n+1}C_mX_{2m}CR_1Y—OCO—C(R_2)=CH_2$$

where n is 2 to 6, m is 0 to 9, X and Y are H, F, Cl, Br or I, Ri is H or alkyl or a substituted alkyl (e.g., an at least partially halo-substituted alkyl), and $R_2$ is H or alkyl or a substituted alkyl (e.g., an at least partially halo-substituted alkyl). In other embodiments, $R_1$ is H, $R_2$ is H, Y is H, and m is 1 to 9. In some embodiments, the monomer include acrylates and methacrylates having perfluorocarbon backbones comprising two to six carbon atoms, such as IH, IH, 2H, 2H-Perfluorooctyl methacrylate or IH, IH, 2H, 2H-Perfluorooctyl acrylate. In some embodiments, the monomer is an organosilane.

In some embodiments in which a PECVD technique is used, the technique can be performed using a roll-to-roll system. In such embodiments, the textile 10 can be guided between first and second rollers and are passed between a plurality of electrode layers used to activate a plasma. The plasma polymerization can be done with relatively low power (e.g., between 5 W to 5000 W) and/or low pressure (e.g., between 10 mTorr and 500 mTorr). The electrode layers can be configured so that both sides of the textile 10 are coated with the organic material and/or the inorganic material. The textile 10 can be degassed by winding the textile 10 from a first roller to a second roller within a vacuum chamber at least one time to remove any moisture content of the textile 10. The degassing process can take place within the same vacuum chamber and roll handling system that is used for plasma polymerization. The degassing process can be done in a separate chamber and then transferred into a polymerization chamber.

In some embodiments in which a PECVD technique is used, the textile 10 can be pre-treated in the form of an activation, cleaning, and/or etching step to improve the adhesion and cross-linking of the coating. The pre-treatment process can be used to remove residues that could reduce the durability of the coating. The pre-treatment can done by passing the textile 10 through a plasma zone. The plasma zone can be formed by introducing an inert gas or a reactive and/or etching gas into the plasma zone, causing a plasma to form in the plasma zone. The out-gassing and pre-treatment steps can be conducted in the same process in the same vacuum chamber.

In some such embodiments, a monomer can be distributed evenly across the chamber and stabilized before the plasma is activated by switching on one or more radiofrequency electrodes. The monomer flow direction can be controlled and switched between different flow directions during a single process. The monomer can be used to strike the plasma to form the deposited polymer coating which thereby substantially obviates the need to use an inert gas, such as helium, nitrogen or argon, as a carrier gas. A carrier gas such as helium or argon can be used to provide stability of the plasma inside the plasma chamber, thereby providing a more uniform thickness of the coating.

As indicated above, in some embodiments, at least one of the filaments 18, 20, 22, 24 can be coated or treated with the hydrophobic material after the warp and weft yarns 14, 16 are woven together to form the textile 10, after any dyeing of the textile 10, and after any finishing of the textile 10. That is, in some embodiments, the finished textile 10 can be coated or treated with the hydrophobic material. Further, the coating or treatment of the hydrophobic material can be applied to the garment 12 or a portion thereof, as described below. In some such embodiments, a PECVD and/or plasma polymerization technique can be used to apply a coating of the hydrophobic material. In other embodiments, one or more of the other techniques described herein can additionally or alternatively be used. In some instances, it can be advantageous to coat or treat the finished textile 10 and/or the garment 12, as opposed to coating or treating the pre-woven filaments 18, 20, 22, 24, because doing so can permit simultaneous application of the coating or treatment to the filaments 18, 20, 22, 24 as well as any seam construction components and/or trim included in the finished textile 10 and/or the garment 12.

The hydrophobicity of the textile 10 can be tested by a spray test according to the AATCC 22 standard of the American Association of Textile Chemists and Colorists (AATCC). In some embodiments, the textile 10 is configured to achieve: (i) a score of at least 80 after 20 sprays; (ii) a score of at least 80 after 30 sprays; and/or (iii) a score of at least 80 after 50 sprays. In some embodiments, the textile 10 has a contact angle for water that is at least 100°, and/or the textile 10 has an oil repellency level of at least 3 according to the ISO 14419 standard of the International Organization for Standardization (ISO).

Referring now to FIGS. 3A-17, the garment 12 including the textile 10 will now be described in detail.

As indicated above, the garment 12 includes one or more panels 26 of the present textile 10 (hereinafter "first panels 26") and, in some embodiments, additionally includes one or more panels 28 of a different material (hereinafter "second panels 28"). At least two of the panels 26, 28 are adjoined together along a seam 30. In some embodiments, the seam 30 forms a substantially water-tight seal between the adjoined panels 26, 28. In some such embodiments, the seam 30 includes at least one hydrophobic material. In other embodiments, the seam 30 does not form a substantially water-tight seal between the adjoined panels 26, 28. In still other embodiments, the garment 12 includes at least one seam 30 that forms a substantially water-tight seal between adjoined panels 26, 28, and at least another seam 30 that does not form a substantially water-tight seal between adjoined panels 26, 28.

The garment 12 can be one of various different types of garments, including, for example, a top (see FIGS. 3A-4C and 10A-11B), pants (see FIGS. 5 and 12), shorts (see FIGS. 6 and 13), and a suit (see FIGS. 7A-9B and 14A-16B). In embodiments in which the garment 12 is a top or a suit, the top can include long sleeves 32 (see FIGS. 3A, 4A, 9A, 9B, 10A, 16A, and 17), short sleeves 34 (see FIGS. 3B, 4B, 8A, 11A, and 15A), or no sleeves (see FIGS. 3C, 4C, 7A, 7B, 14A, and 14B). In embodiments in which the garment 12 is a suit, the suit can include long pant legs 36 (see FIGS. 5, 7A, 9A, 12, 14A, and 16A) or short pant legs 38 (see FIGS. 6, 8A, 13, and 15A).

Figure 3A:
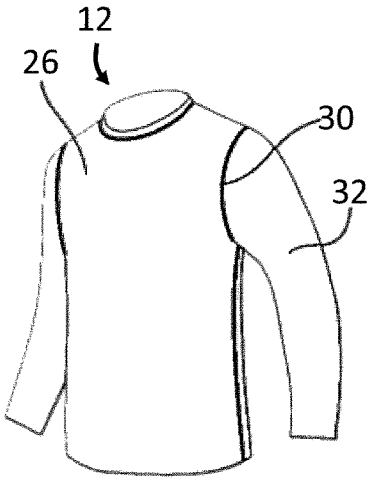
FIGS. 3A-3C each illustrate a front perspective view of an embodiment of a garment (a top) including the present textile.
Figure 3B:
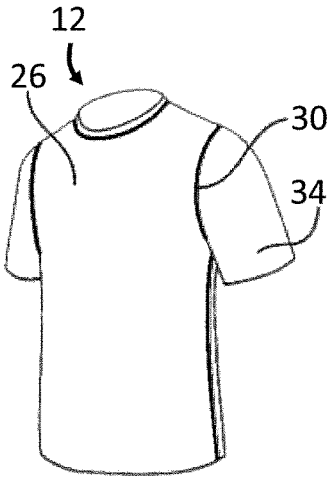
Figure 3C:
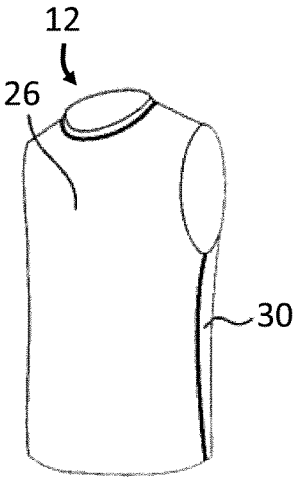
Figure 4A:
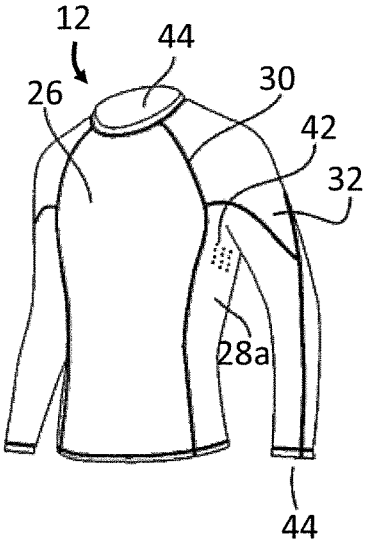
FIGS. 4A-4C each illustrate a front perspective view of an embodiment of a garment (a top) including the present textile.
Figure 4B:
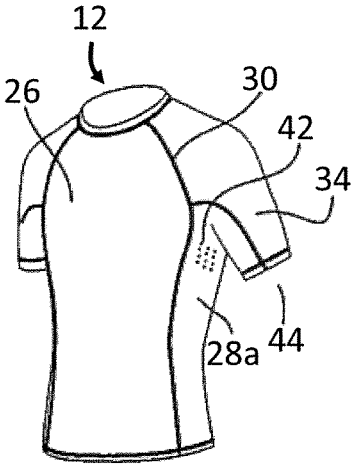
Figure 4C:
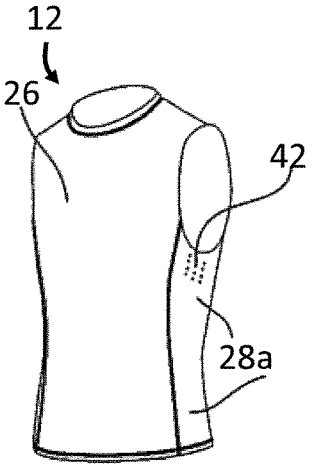
Figure 5:
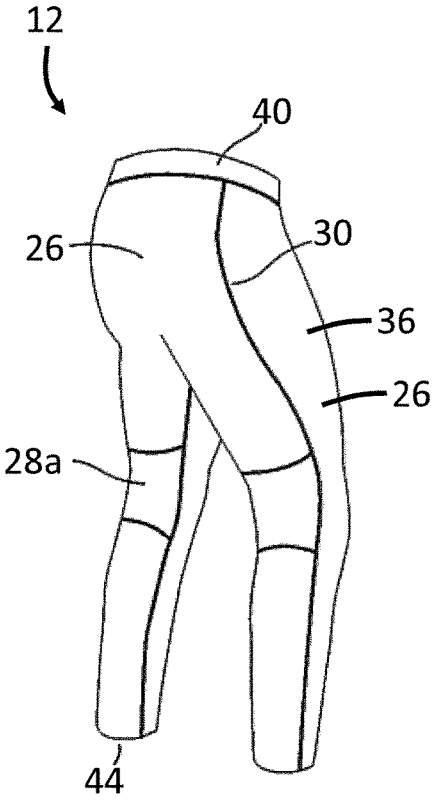
FIG. 5 illustrates a rear perspective view of an embodiment of another garment (pants) including the present textile.
Figure 6:
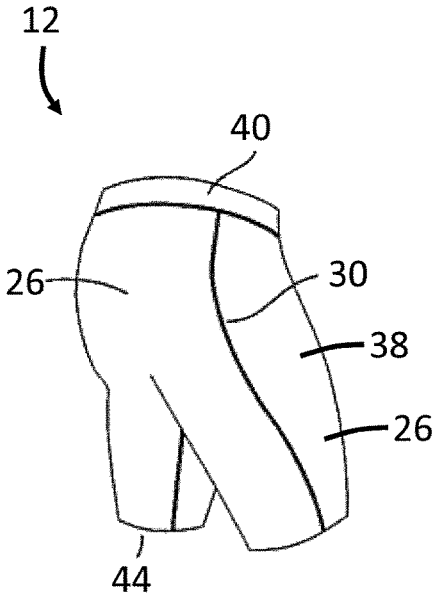
FIG. 6 illustrates a rear perspective view of an embodiment of another garment (shorts) including the present textile.
Figure 7A:
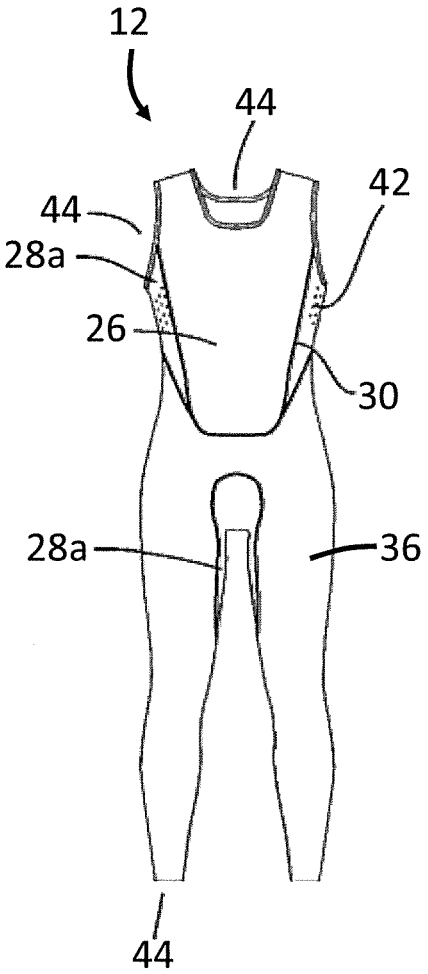
FIGS. 7A and 7B illustrate front and rear elevation views of another garment (a suit) including the present textile, respectively.
Figure 7B:
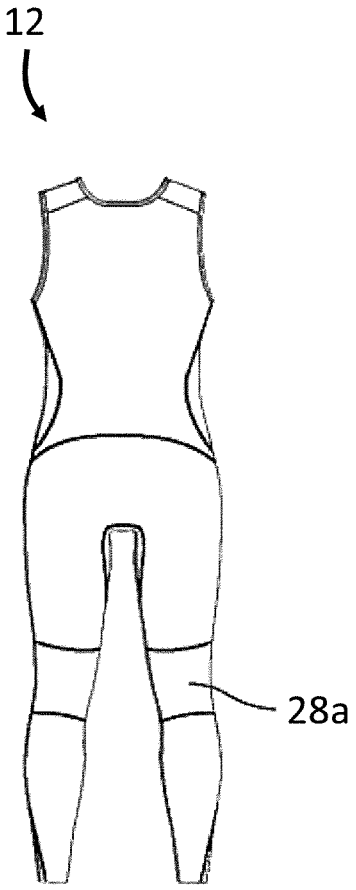

The garment 12 can be configured to be loose-fitting (e.g., configured to fit loosely around the wearers body to allow air to circulate freely inside the garment 12) or form-fitting (e.g., configured to substantially conform to the wearers body). FIGS. 3A-3C illustrate embodiments in which the garment 12 is configured to be loose-fitting. FIGS. 4A-17 illustrate embodiments in which the garment 12 is configured to be form-fitting.

Figure 8A:
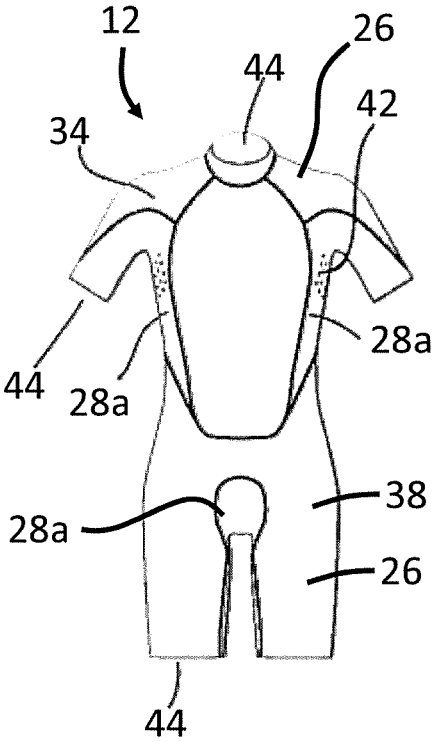
FIGS. 8A and 8B illustrate front and rear elevation views of another garment (a suit) including the present textile, respectively.
Figure 8B:
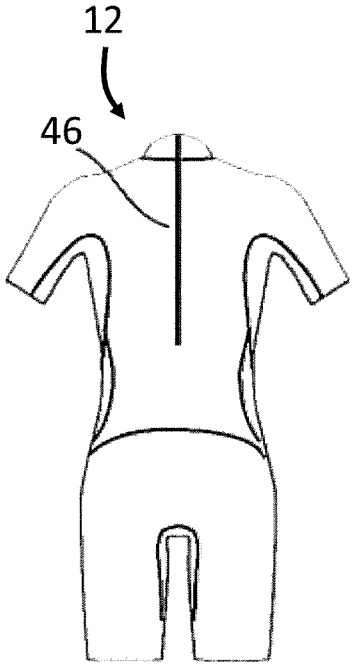
Figure 9A:
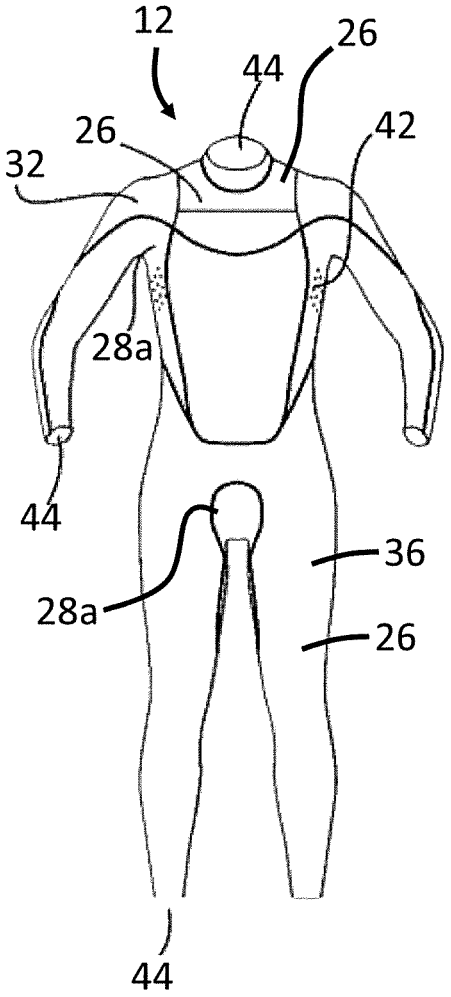
FIGS. 9A and 9B illustrate front and rear elevation views of another garment (a suit) including the present textile, respectively.
Figure 9B:
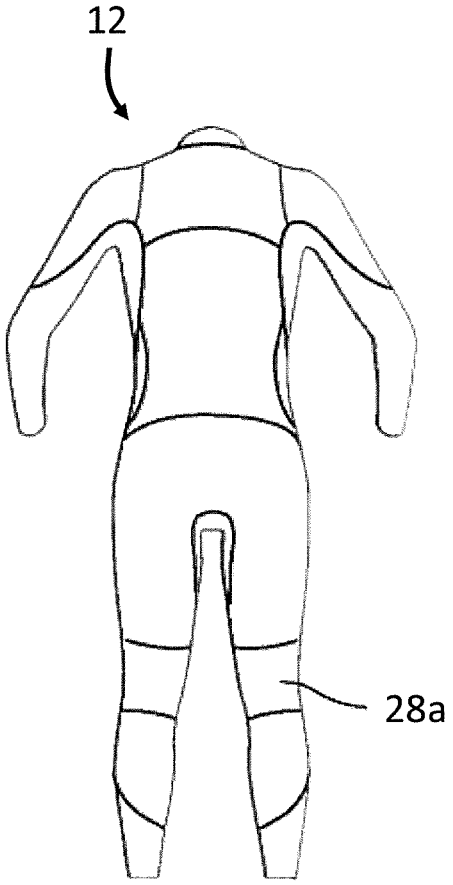
Figure 10A:
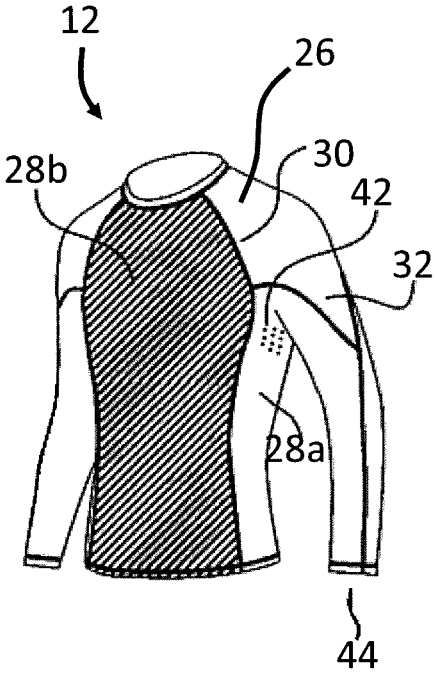
FIGS. 10A and 10B illustrate front and rear perspective views of another garment (a top) including the present textile.
Figure 10B:
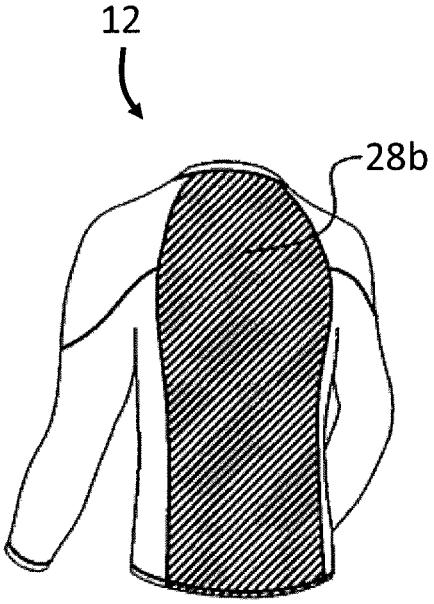
Figure 11A:
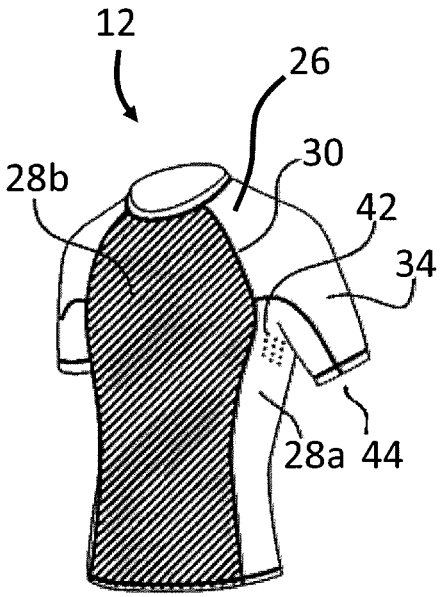
FIGS. 11A and 11B illustrate front and rear perspective views of another garment (a top) including the present textile.
Figure 11B:
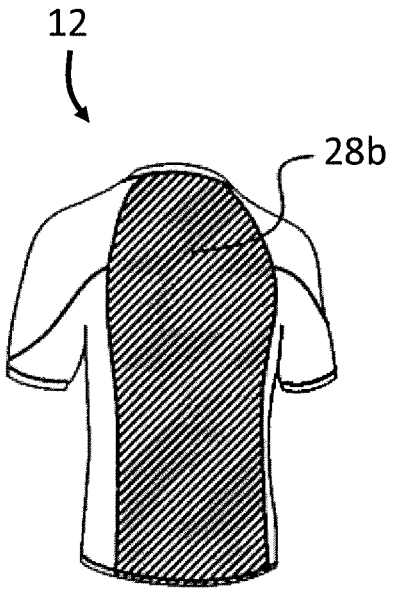
Figure 12:
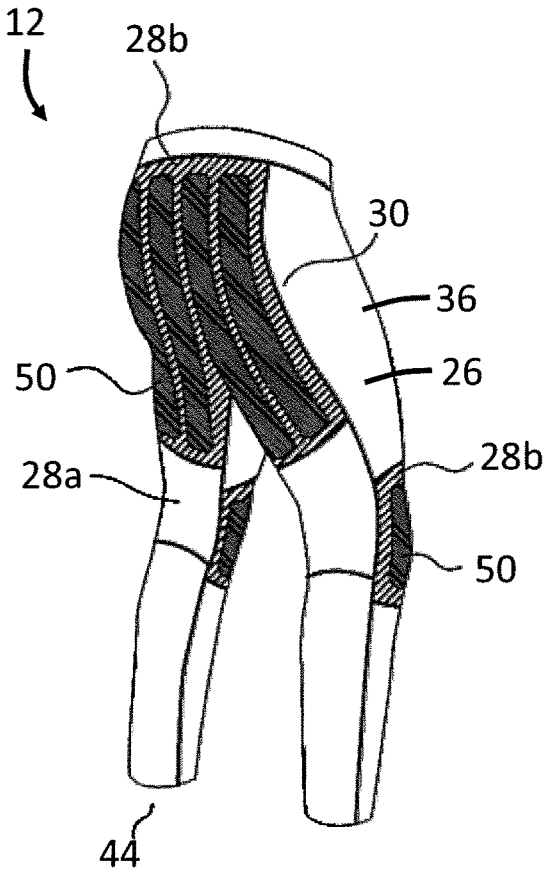
FIG. 12 illustrates a rear perspective view of an embodiment of another garment (pants) including the present textile.
Figure 13:
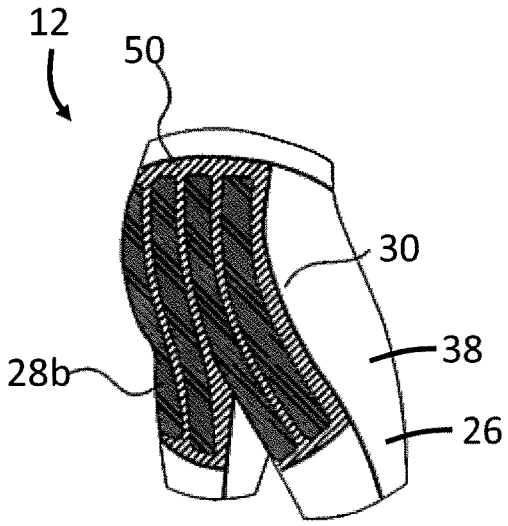
FIG. 13 illustrates a rear perspective view of an embodiment of another garment (shorts) including the present textile.
Figure 14A:
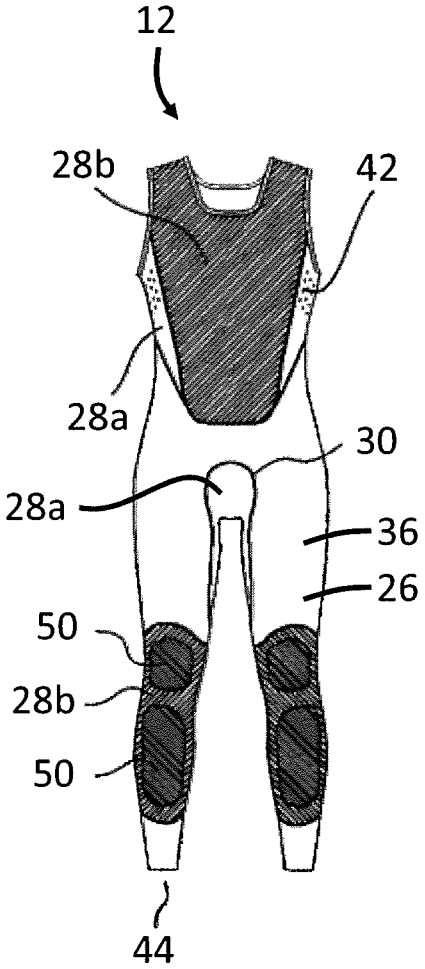
FIGS. 14A and 14B illustrate front and rear elevation views of another garment (a suit) including the present textile, respectively.
Figure 14B:
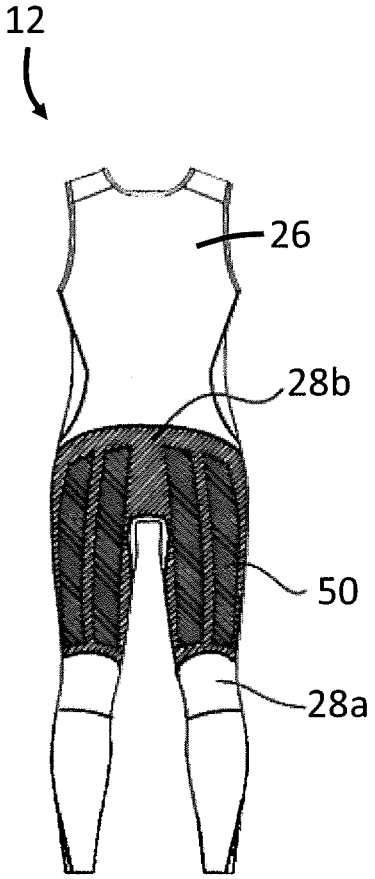
Figure 15A:
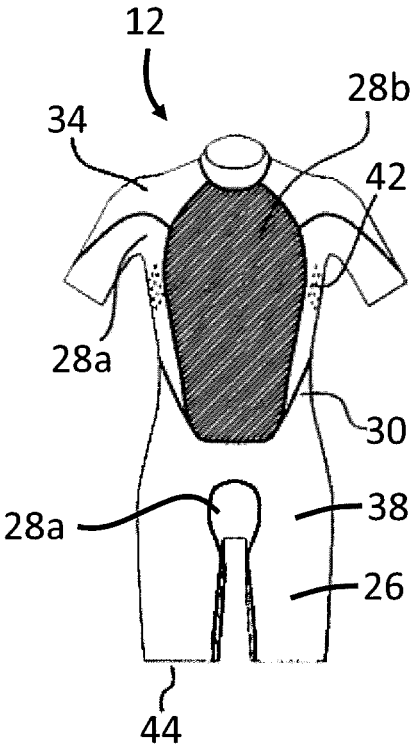
FIGS. 15A and 15B illustrate front and rear elevation views of another garment (a suit) including the present textile, respectively.
Figure 15B:
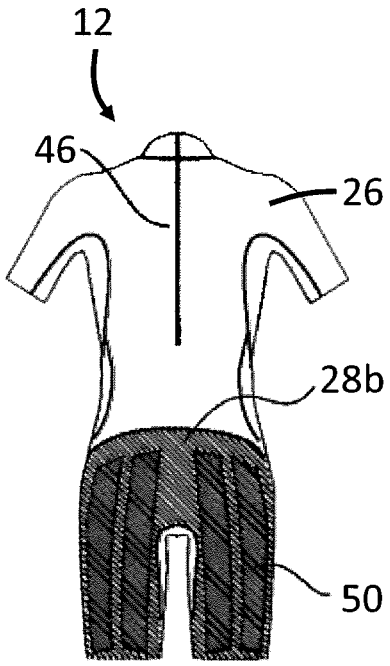
Figure 16A:
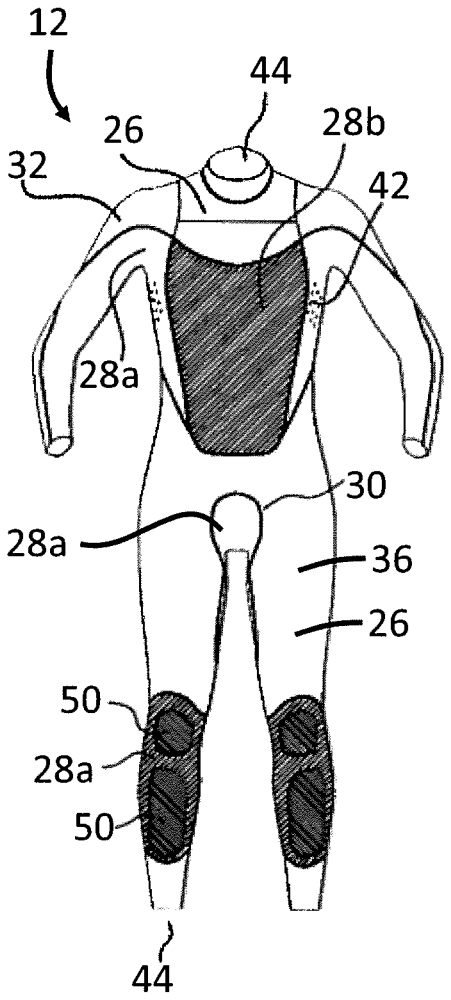
FIGS. 16A and 16B illustrate front and rear elevation views of another garment (a suit) including the present textile, respectively.
Figure 16B:
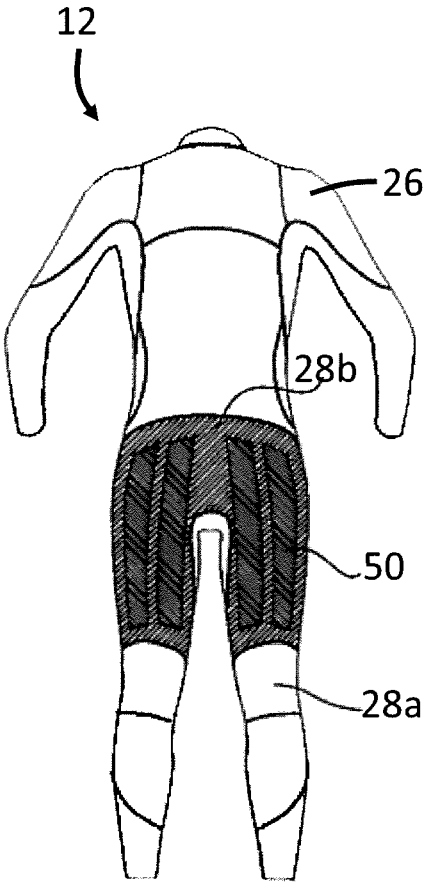

Depending on its type, the garment 12 can have various different features, including, for example, a waistband 40 (see FIGS. 5, 6, 12, etc.), one or more perforations 42 (see FIGS. 4A-4C, 7A, etc.), one or more openings 44 for arms, legs, and/or neck (see FIGS. 4A, 4B, 5, etc.), and/or one or more front-entry or rear-entry zippers 46 (see FIGS. 8B and 15B).

In embodiments that include a waistband 40 (see FIGS. 5, 6, 12, etc.), the waistband 40 can be made of a material with a relatively high elastic modulus, and/or can include high friction grip material, so as to hold the garment 12 in place on the wearers body.

In embodiments that include perforations 42, the perforations 42 can provide one or more portions of the garment 12 with improved air permeability. The perforations 42 can be disposed in one or more of the first panels 26 and/or one or more of the second panels 28. The perforations 42 can be used in both loose-fitting and form-fitting embodiments of the garment 12. The perforations 42 can be positioned on the garment 12 such that, when the garment 12 is worn, the perforations 42 are located proximate an area of the wearer's body where increased air permeability is desired or required (e.g., underarm area, upper or lower back areas, rear leg areas, knee or groin areas, etc.). In FIGS. 4A-4C, 7A, 8A, 9A, 10A, 11A, 14A, 15A, 16A, for example, the respective garments 12 include perforations 42 located in the underarm area.

Figure 17:
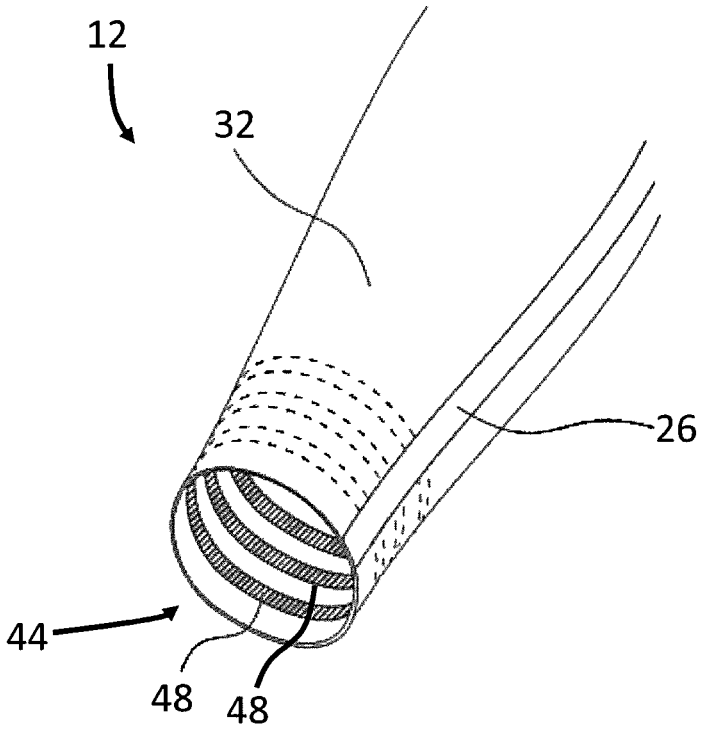
FIG. 17 illustrates a front perspective view of a garment sleeve having a plurality of elastomeric bands disposed therein.

Referring to FIG. 17, in some embodiments that include openings 44 for arms, legs, and/or neck (see FIGS. 4A, 4B, 5, etc.), the garment 12 can include one or more elastomeric bands 48 at one or more of the openings 44. The bands 48 aid in providing a seal against the intrusion of water into the garment 12. The bands 48 can extend continuously or non-continuously about one or more of the openings 44. The bands 48 can have a high amount of friction to hold the relevant portion of the garment 12 in place while also providing the seal. The bands 48 can be made of a polyurethane- and/or silicone-based elastomeric material that provides a high elastic modulus at the openings 44, thereby increasing the tightness of the openings 44. The bands 48 can have a width between 2 mm and 10 mm, and can separated from one another by a distance between 2 mm and 15 mm.

In embodiments in which the garment 12 includes one or more second panels 28, the second panels 28 can be made of various different materials, including, for example, a knitted textile, and a liquid impermeable stretchable textile composite (a "textile composite"). In some embodiments, the garment 12 can have multiple second panels 28, each made from a same or different material relative to one another.

In embodiments in which the second panels 28 are made of a knitted textile (hereinafter "second panels **28*a*"), the knitted textile can be configured to provide increased breathability, thermal regulation, and/or flexibility to the garment 12. The knitted textile can have a lower elastic modulus compared to the textile 10 included in the first panels 26. The knitted textile can be warp knitted, weft knitted, and/or circular knitted. The knitted textile can include nylon, a polyester, a polypropylene, and/or another type of synthetic yarn with at least 10% elastomeric yarn content. The knitted textile can have a jersey, tricot, interlock, and/or eyelet mesh construction. An eyelet mesh construction can provide the second panels 28***a* (and thus one or more portions of the garment 12) with increased levels of air permeability.

In embodiments in which the second panels 28*a* are made of a knitted textile, the second panels 28*a* can be positioned on the garment 12 such that, when the garment 12 is worn, the second panels 28*a* are located proximate an area of the wearer's body where increased air permeability is desired or required (e.g., underarm area, upper or lower back areas, rear leg areas, knee or groin areas, etc.). For example, the garments 12 of FIGS. 4A-16B include second panels 28*a* made of knitted yarn located in the underarm or side body areas, arm or shoulder areas, rear leg areas, and/or groin areas.

In embodiments in which the second panels 28 are made of a textile composite (hereinafter "second panels 28*b*"), the textile composite can be configured to provide reduced water absorbency, comfort, impact and abrasion protection, and/or thermal insulation to the wearer. In some embodiments, the textile composite can be constructed of a neoprene foam and a textile laminate. In other embodiments, the textile composite can be constructed of a neoprene foam and a textile laminated with a moisture vapor permeable and substantially liquid impermeable membrane or membrane coating. In such embodiments, the moisture vapor permeable membrane can provide improved breathability. In still other embodiments, the textile composite can additionally or alternatively include an outer textile laminate selected to be highly resistant to abrasion, so as to provide improved durability to the garment 12.

In embodiments in which the second panels 28*b* are made of a textile composite (hereinafter "second panels 28*b*"), the second panels 28*b* can be positioned on the garment 12 such that, when the garment 12 is worn, the second panels 28*b* are located proximate an area of the wearer's body where such attributes (e.g., reduced water absorbency, comfort, etc.) are desired or required (e.g., knee or groin areas, chest or back areas, seat areas, etc.). The garments 12 of FIGS. 10A-16B include second panels 28*b* made of textile composite located in the chest area, the back area, and/or the seat area.

In some embodiments, the garment 12 can additionally include padding 50. The padding 50 can be positioned on the garment 12 such that, when the garment 12 is worn, the padding 50 is located proximate an area of the wearer's body where padding is desired or required (e.g., seat, knee, elbow, shin, shoulder, spine, or other area). The padding 50 can be made of various different materials, including, for example, open and/or closed cell foam (e.g., neoprene), EVA, a polyurethane, a polystyrene, and/or another foam. The padding 50 can include a dilatant material to improve impact absorption. The padding 50 can be attached to the inside and/or outside of the garment 12 using one or more known techniques, including, for example, gluing, stitching, welding, and/or ultrasonic welding. The padding 50 can additionally or alternatively be removably attached to the garment 12 using a storage pocket or cover panel. In some embodiments, the padding 50 can be configured in multiple panels and/or contoured, perforated, embossed, and/or ribbed to provide flexibility and freedom of movement and/or breathability. The garments 12 of FIGS. 12-16B, for example, include padding 50 located in the seat area and/or the knee area.

Referring now to FIGS. 18A-18G, the seam 30 will now be described in detail.

The seam 30 can have a flat seam stitching construction (see FIGS. 18A and 18C), a folded seam construction (see FIGS. 18B, 18D, and 18E), a fused seam construction (see FIG. 18F and 18G), and/or another type of seam construction. The seam 30 can be constructed using stitching (e.g., flatlock stitching, overlook stitching, zig-zag stitching, cover stitching, etc.), taping, bonding, fusing, ultrasonic welding, gluing, and/or one or more other known techniques.

In embodiments in which the seam 30 has a flat seam stitching construction (see FIGS. 18A and 18C), the adjoined panels 26, 28 can slightly overlap one another, and the seam 30 can include at least one stitch yarn 52 that is looped through the overlapping portions of the adjoined panels 26, 28. In some embodiments, two of the first panels 26 are adjoined by a seam 30 with a flat seam stitching construction. In such embodiments, the stitch yarn 52 includes (e.g., is formed of, is coated with, is treated with) a hydrophobic material, and the seam 30 forms a substantially water-tight seal. The hydrophobic stitch yarn 52 can be structurally and/or compositionally the same as or similar to the warp and/or weft yarns 14, 16 of the textile 10. Accordingly, the various materials that can be used for the hydrophobic stitch yarn 52 will not be discussed in detail again. In other embodiments, a first panel 26 and a second panel 28 are adjoined by a seam 30 with a flat seam stitching construction. In such embodiments, the stitch yarn 52 may not include a hydrophobic material, and the seam 30 may not form a substantially water-tight seal.

In embodiments in which the seam 30 has a folded seam construction (see FIGS. 18B, 18D, and 18E), the seam 30 includes at least one stitch yarn 52 that is looped through folded edge portions of the adjoined panels 26, 28. The folded seam construction can be used to form a seam 30 between two of the first panels 26, or between a first panel 26 and a second panel 28. In both instances, the seam 30 can form a substantially water-tight seal between the adjoined panels 26, 28. The folded seam construction can be used to position the stitch yarn 52 (and the stitch holes through which the stitch yarn 52 is looped) on the inside of garment 12, and can thus substantially eliminate the possibility that water will pass between the panels 26, 28 via absorption through the stitch yarn 52 and/or by flowing through the stitch holes. This can reduce or eliminate any need to provide a stitch yarn 52 that includes a hydrophobic material, and can be especially useful in embodiments in which the folded seam construction is used to form a seam 30 between two of the (hydrophobic) first panels 26.

In embodiments in which the seam 30 has a fused seam construction (see FIGS. 18F and 18G), the seam 30 can include a stretchable adhesive 56. The adhesive 56 can be made of a polyurethane hot-melt adhesive that is bonded to the adjoined panels 26, 28 by ultrasonic welding, heat pressing, heat taping, and/or another known technique. In some embodiments, the adhesive 56 includes (e.g., can be formed of, can be coated with, can be treated with, etc.) a hydrophobic material. In some embodiments (see FIG. 18G), the adhesive 56 can be disposed between overlapping portions of the adjoined panels 26, 28. In other embodiments (see FIG. 18F), the adhesive 56 can be disposed on inner or outer surfaces of the adjoined panels 26, 28 proximate portions of the panels 26, 28 that abut one another. In such embodiments and other embodiments, the adhesive 56 can be used together with a sealing tape 54, as will be described in more detail below. The fused seam construction can be used to form a seam 30 between two of the first panels 26, or between a first panel 26 and a second panel 28. In both instances, the seam 30 can form a substantially water-tight seal between the adjoined panels 26, 28.

In some embodiments (see FIGS. 18C, 18D, and 18E), the seam 30 includes a sealing tape 54 that forms, or aids in forming, a substantially water-tight seal between the adjoined panels 26, 30. The tape 54 can be applied using the above-described stretchable adhesive 56 applied by hand gluing, hot melt gluing, ultrasonic welding, and/or another known technique. In some embodiments, the tape 54 includes (e.g., can be formed of, can be coated with, can be treated with, etc.) a hydrophobic material. The tape 54 can be made of a stretchable water-resistant woven or knitted textile or liquid impermeable polymeric film or composite thereof. The sealing tape 54 can be combined with a polyurethane hot-melt adhesive prior to or during application of the tape 54 to the garment 12.

Figure 18A:
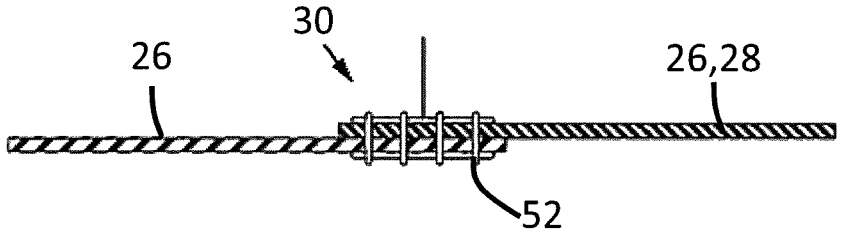
FIGS. 18A-18G each illustrate embodiments of a seam that can be included in the present garment.
Figure 18B:
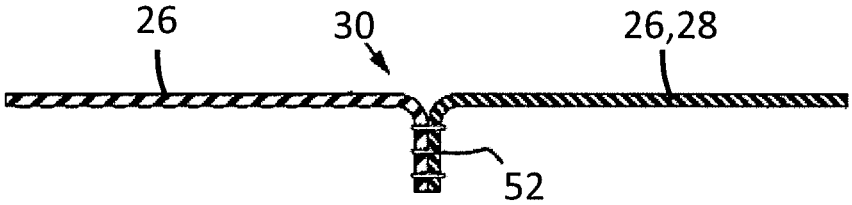
Figure 18C:
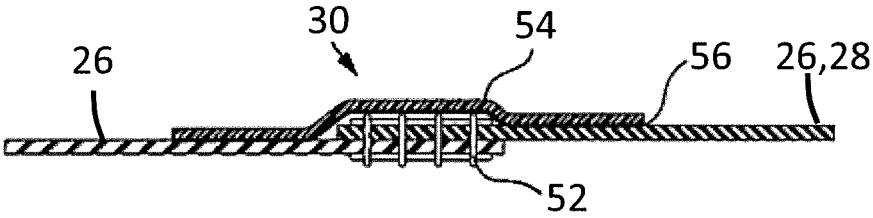
Figure 18D:
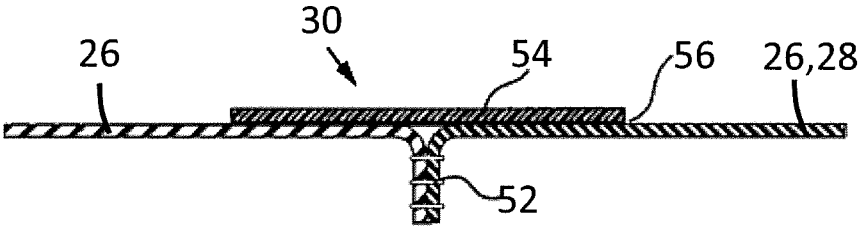
Figure 18E:
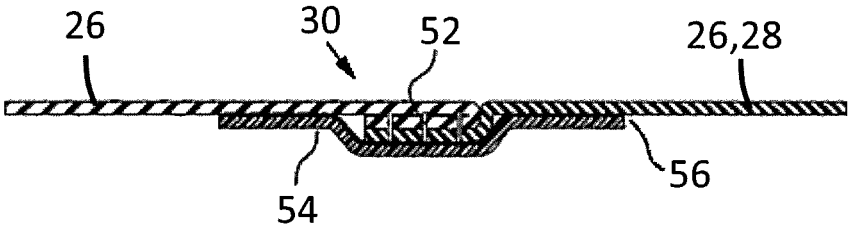
Figure 18F:
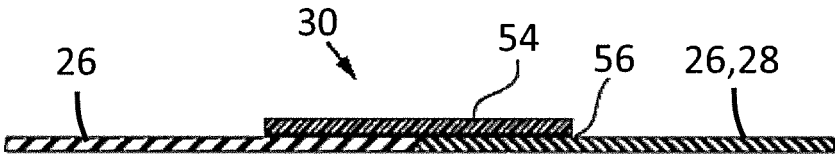
Figure 18G:
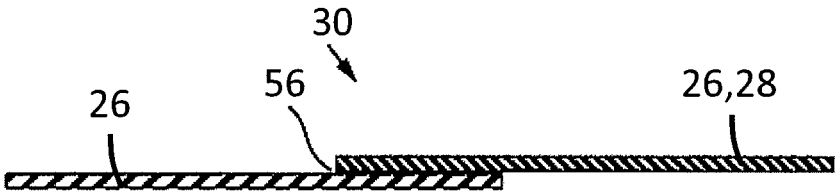

The tape 54 can be used in seams 30 that are constructed using a flat seam stitching construction (see FIG. 18C), a folded seam construction (see FIGS. 18D and 18E), and/or a fused seam construction (see FIG. 18F). In embodiments in which a flat seam stitching construction is used (see FIG. 18C), the tape 54 can be positioned on the inside of the garment 12 (not shown) and/or on the outside of the garment 12 (see FIG. 18C), and disposed on at least a portion of the stitch yarn 52. In embodiments in which a folded seam construction is used (see FIGS. 18D and 18E), the tape 54 can be positioned on the inside of the garment 12 (see FIG. 18E) and/or on the outside of the garment 12 (see FIG. 18D). In embodiments in which a fused seam construction (see FIGS. 18F and 18G), the tape 54 can be disposed substantially flush with the adjacent panels 26, 28 (see FIG. 18F), which can provide a comfortable, smooth surface on an inside or outside surface of the garment 12 free from stitching or overlapping panels 26, 28. In some embodiments, a first panel 26 and a second panel 28 are adjoined by a seam 30 including the tape 54. In other embodiments, two of the first panels 26 are adjoined by a seam 30 including the tape 54.

Figure 19:
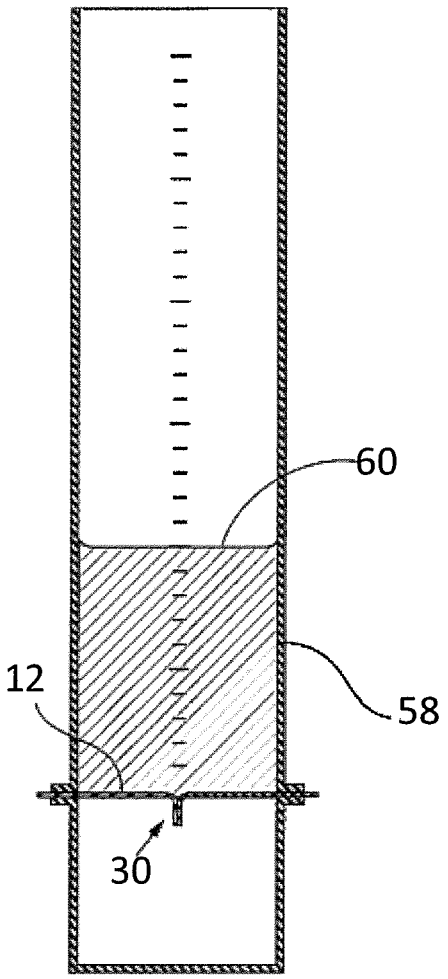
FIG. 19 illustrates a device used for testing an amount of water leakage through the seam of the garment.

In embodiments in which the seam 30 includes a hydrophobic material, the hydrophobic material can allow for a significantly improved seal between the at least two panels 26, 28 as compared to similar seams that lack a hydrophobic material. To measure the improvements, each seam 30 underwent a pressure test, in which a portion of the garment 12 including the seam 30 was secured around a 65 mm diameter cylinder 58 (see FIG. 19) with the seam 30 positioned within the cylinder 58. 2.25 milliliters (mL) of water was added to the cylinder 58 every 30 seconds until any drip was observed through the seam 30. The water level 60 within the cylinder 58 was recorded at observation of water leaking through seam 30. The embodiments shown in FIGS. 18C-18G experienced no leakage at the highest measurable pressure of 225 mmHg. The embodiment in FIG. 18A experienced minimal water leakage at 100 mmHg, but the same construction without the hydrophobic material experienced leakage at 25 mmHg. The embodiment in FIG. 18B experienced minimal water leakage at 150 mmHg, but the same construction without the hydrophobic material experienced leakage at 100 mmHg.

The present textile 10, and thus the present garment 12, offer significant and advantages over known textiles and garments used for aquatic activities, respectively. Several tests were performed to prove such advantages. Referring to FIG. 20, for example, a test was performed to prove that the present textile 10 absorbs significantly less water (i.e., has a higher hydrophobicity) than known textiles used for aquatic activities. The test included: (i) three samples of a prior art knitted textile, each sample having a different hydrophobic material treatment (i.e., no treatment, DWR treatment via a dipping technique, and DWR treatment via a PECVD technique); (ii) three samples of a first embodiment of the present textile 10, each sample having one of the three hydrophobic material treatments; and (iii) three samples of a second embodiment of the present textile 10, each sample having one of the three hydrophobic material treatments.

The prior art knitted textile included a plurality of yarns, in which 80% of the yarn filaments were made of nylon, and 20% were made of elastane. The first embodiment of the present textile 10 included warp and weft yarns 14, 16 as described herein. The elastic warp filaments 18 and elastic weft filaments 22 were made of an elastane and made up 23% of the warp and weft yarns 14, 16, and the non-elastic warp filaments 20 and non-elastic weft filaments 24 were made of a polyester and made up the remaining 77% of the warp and weft yarns 14, 16. The first embodiment of the present textile 10 had a surface density of 170 gsm. The second embodiment of the present textile 10 also included warp and weft yarns 14, 16 as described herein. The elastic warp filaments 18 and elastic weft filaments 22 were made of an elastane and made up of 25% of the warp and weft yarns 14, 16, and the non-elastic warp filaments 20 and non-elastic weft filaments 24 were made of nylon and made up the remaining 75% of the warp and weft yarns 14, 16. The second embodiment of the present textile 10 had a surface density of 140 gsm.

Still referring to FIG. 20, the test involved providing a panel of each sample. The panels each had a size of 250 mm×250 mm. The samples were weighed (see "Dry Weight" in FIG. 20). The samples were then immersed in fresh water for 2 minutes, and were continuously stirred within the water. The samples were then lifted from the water and allowed to drain for 20 seconds. The samples were then weighed a second time (see "Wet Weight" in FIG. 20). For each sample, the difference between the measured wet weight and dry weight was then calculated to determine the water weight in each sample (see "$H_2$0 Content" in FIG. 20). The water weight in each sample was then divided by the measured dry weight to determine the percentage increase of water weight as a result of immersion in the water (see "% Increase of Weight in $H_2O$" in FIG. 20).

The test results in FIG. 20 show that, for the three samples having no hydrophobic material treatment, the first and second embodiments of the present textile 10 both absorbed significantly less water than the prior art knitted textile, and the second embodiment of the present textile 10 (having polyester and elastane yarn filaments and a surface density of 170 gsm) absorbed less water than the first embodiment of the present textile 10 (having nylon and elastane yarn filaments and a surface density of 140 gsm). The same is true for the three samples having a DWR treatment applied via a dipping technique, and for the three samples having a DWR treatment applied via a PECVD technique.

While several embodiments have been disclosed, it will be apparent to those of ordinary skill in the art that aspects of the present invention include many more embodiments and implementations. Accordingly, aspects of the present invention are not to be restricted except in light of the attached claims and their equivalents. It will also be apparent to those of ordinary skill in the art that variations and modifications can be made without departing from the true scope of the present disclosure. For example, in some instances, one or more features disclosed in connection with one embodiment can be used alone or in combination with one or more features of one or more other embodiments.

What is claimed is:

1. A garment, comprising:

a first panel of a first textile, the first textile including a plurality of warp yarns and a plurality of weft yarns woven together;

at least one of the plurality of warp yarns and the plurality of weft yarns includes a hydrophobic material;

respective materials of the plurality of warp yarns and the plurality of weft yarns are selected such that the first textile has a high elastic stretchability in at least one of a weft direction and a warp direction; and the garment further comprising a second panel that is a liquid impermeable stretchable textile composite, the second panel positioned on the garment such that, when the garment is worn, the second panel is located proximate an area of a wearer's body, the area being at least one of a knee area, a groin area, a chest area, a back area, and a seat area.

2. The garment of claim 1, wherein the first panel and the second panel are adjoined together along a seam that forms a substantially water-tight seal between the first panel and the second panel.

3. The garment of claim 2, wherein the seam includes a hydrophobic material.

4. The garment of claim 3, wherein the seam has a flat seam construction, including a stitch yarn that is looped through the first panel and the second panel, the stitch yarn including a hydrophobic material.

5. The garment of claim 2, wherein the seam has a folded seam construction including a stitch yarn that is looped through the first panel and the second panel, and the stitch yarn does not include a hydrophobic material.

6. The garment of claim 2, wherein the seam has a fused seam construction, including a stretchable adhesive disposed relative to the first panel and the second panel.

7. The garment of claim 6, wherein the stretchable adhesive includes a hydrophobic material.

8. The garment of claim 2, wherein the seam includes an adhesive tape.

9. The garment of claim 8, wherein the adhesive tape includes a hydrophobic material.

10. The garment of claim 1, wherein the first panel includes a plurality of perforations extending therethrough for air permeability.

11. The garment of claim 1, wherein the garment is designed to be loose-fitting on a wearer.

12. The garment of claim 1, wherein the garment is designed to be form-fitting on a wearer.

13. The garment of claim 1, further comprising a waistband made of a material with a relatively high elastic modulus and/or a high friction grip material.

14. The garment of claim 1, further defining an opening for an arm, a leg, or a neck.

15. The garment of claim 14, wherein an elastomeric band is positioned on an inside of the garment proximate the opening, the elastomeric band having a high amount of friction for holding the garment in place on a wearer.

16. The garment of claim 1, further comprising padding positioned on the garment such that, when the garment is worn, the padding is located proximate an area of a wearer's body where padding is desired.

17. The garment of claim 1, wherein respective materials of the plurality of warp yarns and the plurality of weft yarns are selected such that the first textile has a high elastic stretchability in both the weft direction and the warp direction.

18. The garment of claim 1, wherein respective materials of the plurality of warp yarns and the plurality of weft yarns are selected such that the first textile has a high elastic stretchability in only the warp direction or only the weft direction.

19. The garment of claim 1, wherein the second panel is configured to provide at least one of reduced water absorbency, comfort, impact and abrasion protection, and thermal insulation to a wearer.

20. The garment of claim 1, wherein the liquid impermeable stretchable textile composite of the second panel includes a neoprene foam and a textile laminate.

21. The garment of claim 1, wherein the liquid impermeable stretchable textile composite of the second panel includes a neoprene foam and a textile laminated with a moisture vapor permeable and substantially liquid impermeable membrane or membrane coating.

22. The garment of claim 1, wherein the liquid impermeable stretchable textile composite of the second panel includes an outer textile laminate selected to be highly resistant to abrasion.

* * * * *